United States Patent [19]

Shinozaki et al.

[11] Patent Number: 4,499,449

[45] Date of Patent: Feb. 12, 1985

[54] SPEED SETTING DEVICE FOR A SEWING MACHINE

[75] Inventors: Nozomu Shinozaki; Takashi Dohi, both of Hirakata; Shinji Yamazaki, Yao; Shigeo Neki, Osaka, all of Japan

[73] Assignee: Matsushita Electric Industrial Company, Ltd., Japan

[21] Appl. No.: 386,785

[22] Filed: Jun. 7, 1982

[30] Foreign Application Priority Data

Jun. 11, 1981 [JP] Japan ..... 56-89882

[51] Int. Cl.[3] ..... H01L 43/02

[52] U.S. Cl. ..... 338/32 R; 338/153

[58] Field of Search ..... 112/217.3, 275; 338/12, 338/32 R, 32 H, 153; 318/480, 139; 74/474, 478, 478.5; 84/DIG. 25, 225, 357, 353, 1.27, 1.17

[56] References Cited

U.S. PATENT DOCUMENTS

| | | | |
|---|---|---|---|
| 1,772,361 | 8/1930 | Mross et al. | 338/153 |
| 2,455,691 | 12/1948 | McCulloch | 74/478 X |
| 2,501,159 | 3/1950 | Clark | 338/153 X |
| 2,534,939 | 12/1950 | Alkire | 338/153 |
| 4,100,868 | 7/1978 | Reinecke et al. . | |
| 4,125,821 | 11/1978 | Masuda | 338/32 R |
| 4,132,970 | 1/1979 | Masuda et al. | 338/32 R |

FOREIGN PATENT DOCUMENTS

| | | |
|---|---|---|
| 2913861 | 10/1980 | Fed. Rep. of Germany . |
| 51-150447 | 12/1976 | Japan . |
| 55-143724 | 11/1980 | Japan . |

*Primary Examiner*—Ulysses Weldon

*Attorney, Agent, or Firm*—Lowe, King, Price & Becker

[57] ABSTRACT

A speed setting device for an industrial sewing machine comprises a lever pivotally mounted at one end thereof on a stationary wall and adapted to be pivotally moved in response to the foot pedal of the sewing machine. An arm is pivotally mounted at one end to the stationary wall and operatively engaged with the lever so that they rotate in unison about respective pivot points thereof. The pivot point of the second member is between the lever pivot point and the engagement point between the lever and arm. Thereby, the arm is rotated through an angle greater than the angle through which the lever is rotated in response to the angular displacement of the foot pedal. An angular displacement sensor detects the angular displacement of the arm to generate a speed setting signal.

7 Claims, 7 Drawing Figures

SPEED SETTING DEVICE FOR A SEWING MACHINE

BACKGROUND OF THE INVENTION

The present invention relates generally to industrial sewing machines, and in particular to a speed setting device for such sewing machines.

Industrial sewing machines includes a motor and a control box fixed to the underside of the motor. An operator-controlled lever is pivotally mounted on one side wall of the control box, one end of the pivoted lever being connected by a pitman i.e., rod connecting to a foot pedal of the sewing machine. The angular displacement of the foot pedal is transmitted via the lever to inside of the control box where a swingable arm is located. The free end of the arm is shaped as an arch adjacent to which is located an angular displacement sensor for generating a speed setting signal in response to the rotation of the arm. The speed setting signal is used to control the speed of the motor to effect various automatic functions including variable speed control, needle position detection and stoppage and thread cutting operation. One disadvantage of the conventional speed setting device is that the lever and the arm must be rigidly coupled together with such a strength that there is no slippage at the point of coupling. If this strength is not sufficient, the slippage will result in an error in the speed setting signal. Another disadvantage relates to the fact that the maximum range of angular displacement is not sufficient for the displacement sensor to generate a position signal which is an accurate representation of the angular position of the foot pedal. As a result, an extra device is needed for amplifying the amount of angular displacement of the arm.

SUMMARY OF THE INVENTION

The present invention provides an improved speed setting device for industrial sewing machines which is free from the problems associated with conventional speed setting devices.

A device for generating a sewing machine speed setting signal in response to an angular displacement caused by an operator's action comprises a first member pivotally mounted at one end thereof on a first rotary axis of a stationary member. The first member turns about the first rotary axis in response to the angular displacement. A second member is pivotally mounted at one end thereof on a second rotary axis that is spaced from the first rotary axis and is on the stationary member. A shaft extends transversely from one of the first and second members to the other member through an opening provided on the other member for rotatably coupling the first and second members at a point adjacent the second rotary axis. The point is remote from the first rotary axis so that said second member rotates through an angle greater than the angle through which the first member rotates. The first and second members are urged against each other to minimize the amount of loose play which might otherwise exist between the shaft and opening. A magnetic flux sensor generates the speed setting signal in response to flux from a magnetic flux generator. One of the flux generator or sensor is mounted on the second member in coaxial relationship with the second rotary axis. The other of said flux generator and sensor is mounted on the stationary member coaxially with and spaced from the means mounted on said second member. A spacer is located between the flux generator and sensor, which are urged toward each other.

BRIEF DESCRIPTION OF THE DRAWINGS

The present invention will be described in further detail with reference to the accompanying drawings, in which.

DETAILED DESCRIPTION

Figure 1:
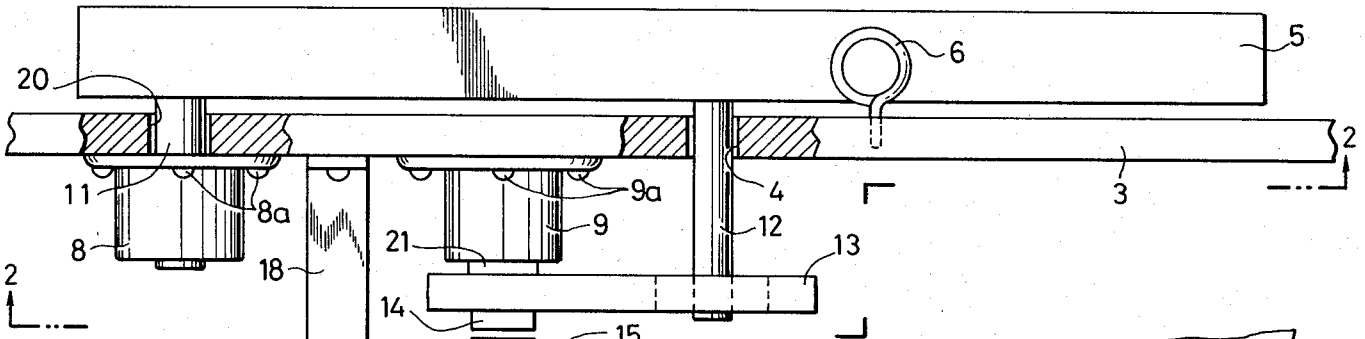
FIG. 1 is a plan view of the speed setting device according to the invention.
Figure 2:
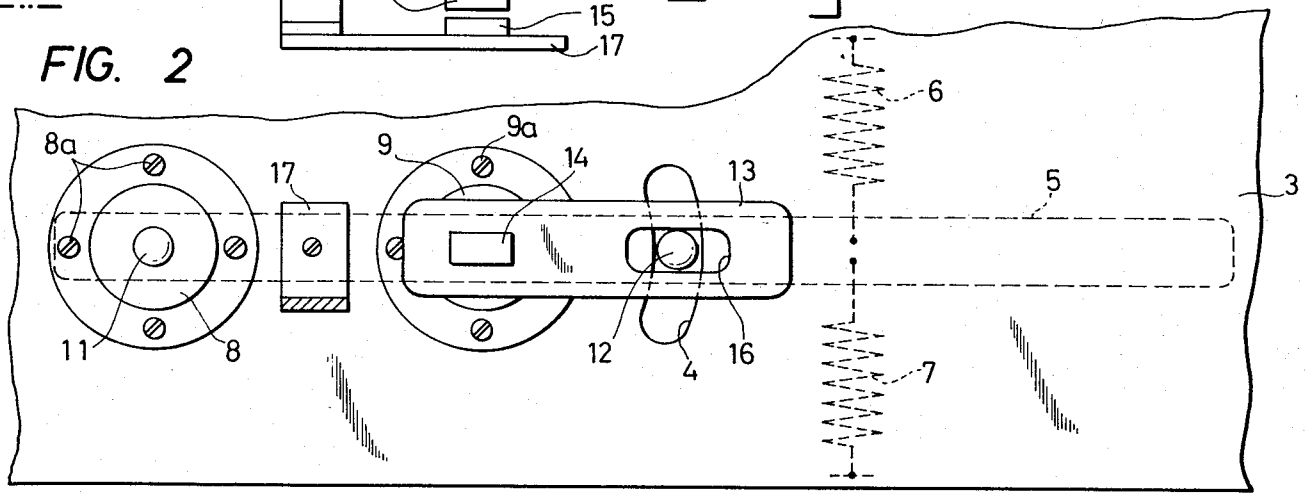
FIG. 2 is a view in side elevation of the device of FIG. 1.

Referring to FIGS. 1 and 2, there is shown a preferred embodiment of the speed setting device of the present invention for generating a speed setting signal of a sewing machine by detecting the angular displacement of a foot pedal in response to an operator's action. The speed setting device comprises a lever 5 having an iron pivot shaft 11 firmly inserted to one end of thereof. A linkage shaft 12 extends parallel with the pivot shaft 11 from a point intermediate the ends of the lever 5. Preferably, the lever 5 is formed by aluminum diecast or molded resin injection technique.

The pivot shaft 11 extends through an opening 20 of a wall 3 and is rotatably mounted on a bearing 8 secured to the wall 3 opposite to the lever 5 by screws 8*a*. The wall 3 forms part of a control box of the industrial sewing machine and is formed with a part-circular opening 4 through which the linkage shaft 12 extends to operatively engage with an elongated opening 16 of a rotary arm 13. On each of arm 13 is fixedly connected to a pivot shaft 21 which is rotatably mounted on a bearing 9 secured to the wall 3 by screws 9*a*. The arm 13 and its pivot shaft 21 are preferably formed of the same material as the pivot shaft 11. Likewise, the bearings 8 and 9 are each formed of an oil-impregnated molded polyacetal to assure smooth movement of the levers 5 and 13 for an extended period of time.

A permanent magnet 14 is fitted to the pivot shaft 21 of the arm 13 so that the direction of magnetic flux rotates with the rotation of the arm 13. A magnetic sensor such as magnetoresistive element 15 is mounted on a printed circuit assembly 17 which is secured by a bracket 18 to the wall 3, whereby the pivot movement of the arm 13 is detected by a change in voltage generated by the magnetic sensor 15.

The lever 5 is maintained in a neutral position by upper and lower springs 6 and 7, secured to the wall 3. The lever 5 is suitably linked by a pitman, i.e. connecting rod, to the foot pedal, not shown, of the sewing machine so that when the foot pedal is depressed forward from a neutral position the lever 5 is rotated counterclockwise as indicated by a solid line in FIG. 3 and when the foot pedal is depressed backward from the neutral position the lever 5 is turned clockwise as indicated by a dot-dash line.

Figure 3:
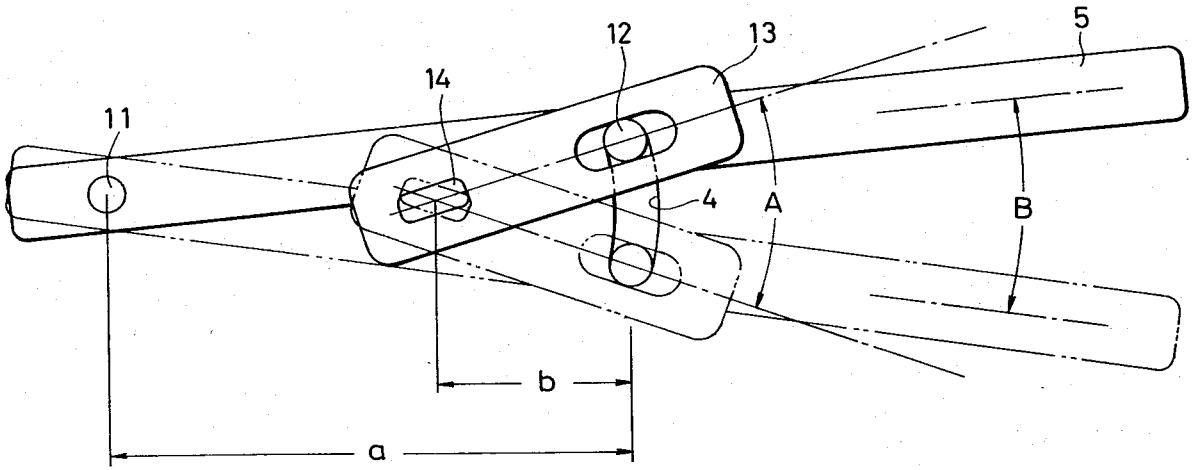
FIG. 3 is a schematic view for describing the operation of the device of the invention.

It will be seen from FIG. 3 that since the pivot point of arm 13 is located between the shafts 11 and 12 (approximately on detector 14), the arm 13 rotates through an angle A that is greater than angle B through which the lever 5 is rotated in response to the foot pedal. The angle of rotation of lever 5 is thus amplified by the ratio A/B which is seen from FIG. 3 to be equal to the ratio of distance a between the shafts 11 and 12 to distance b between the shafts 21 and 12. Therefore, the permanent magnet 14 rotates at a ratio of a/b with respect to the stationary magnetic sensor 15 for a given angular movement of the foot pedal. The voltage generated by the magnetic sensor 15 changes in sufficiently spaced apart quantities to be used to generate correct position indicating digital signals.

Figure 4:
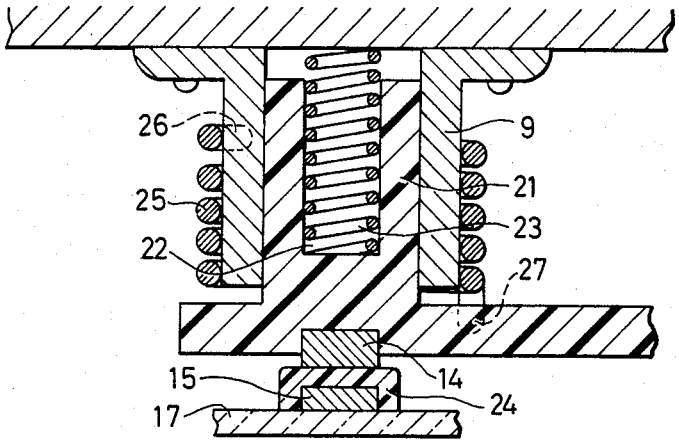
FIG. 4 is a cross-sectional view of a bearing of FIG. 1.

FIG. 4 is an illustration of the detail of the bearing 9 for pivot shaft 21. In order to ensure that the voltage developed by the magnetic sensor 15 is an accurate indication of the amount of depression of foot pedal, it is preferable that the distance between the magnet 14 and magnetic sensor 15 be maintained constant. This is accomplished by an arrangement comprising a spacer 24 which is attached to the surface of the magnetic sensor 15. The shaft 21 of arm 13 is formed with cylindrical cavity 22 in which a compression spring 23 is disposed to urge the magnet 14 slightly against the spacer 24. A further arrangement for accurate indication of the depression includes a torsion spring 25 which is coiled around the bearing 9 with first and second ends respectively fixed to the bearing at point 26 and to the arm 13 at point 27. The spring 25 biases the arm 13 against the second shaft 12 of the lever 5 to eliminate loose play which might otherwise occur between shaft 12 and the inner wall of the slotted opening 16 (FIG. 2) so that the lever 5 and the rotary arm 13 rotate in complete unison.

Figure 5:
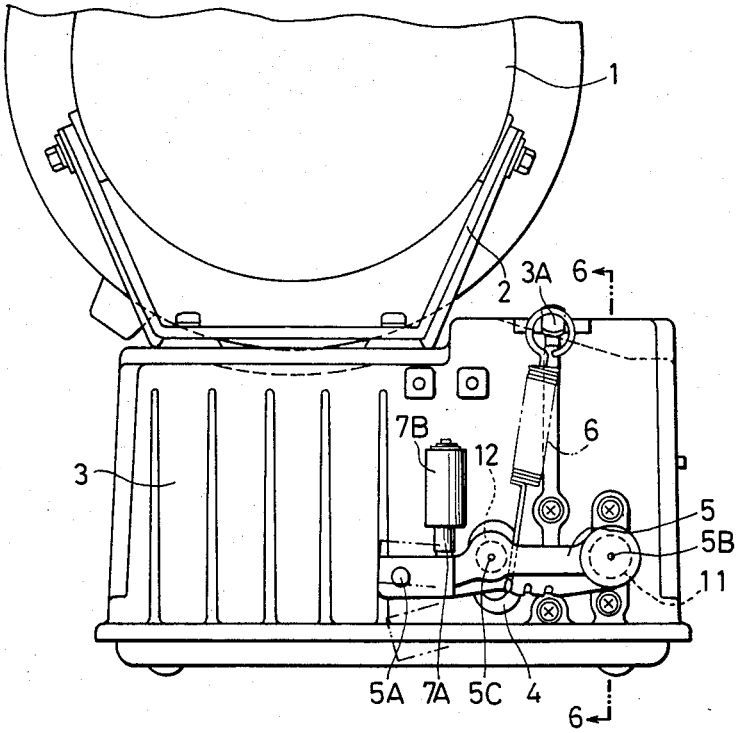
FIG. 5 is an illustration of a practical embodiment of the speed setting device of the invention.
Figure 6:
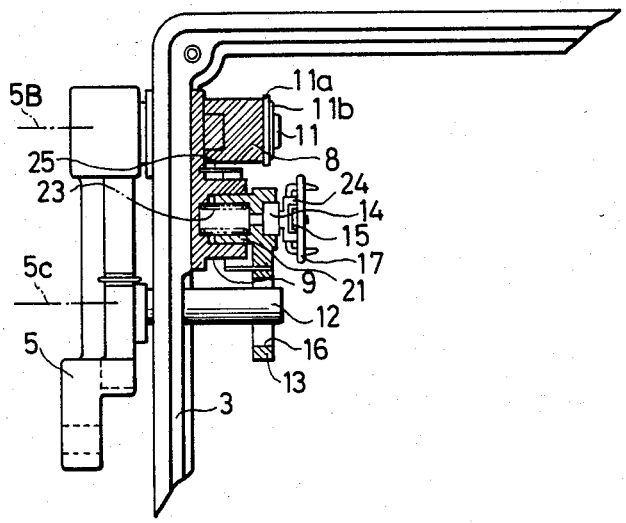
FIG. 6 is an underside view of the speed setting device of FIG. 5.
Figure 7:
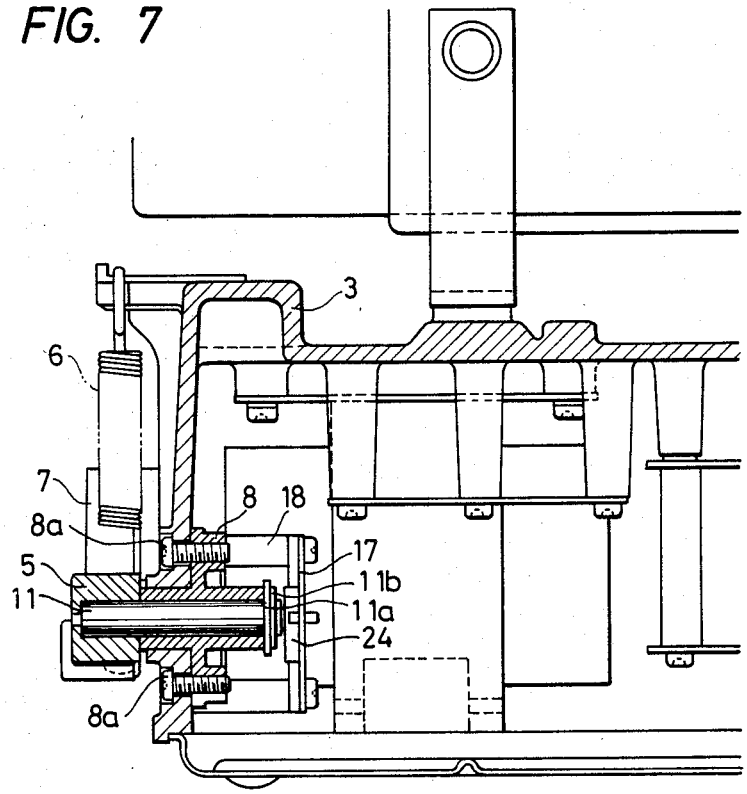
FIG. 7 is an illustration of the detail of a part of the speed setting device of FIG. 5.

FIGS. 5 to 7 are illustrations of a practical embodiment of the invention that includes a motor, (FIG. 5) which is mounted below the sewing machine table, not shown. The control box 3, which is resin molded or aluminum diecast, is fixed to the motor 1 by a metal fixture or bracket 2. The lever 5, which is also resin molded or aluminum diecast, is connected to the pivot shaft 11 at 5B and to the connecting shaft 12 at 5C. The lever 5 has at the free end thereof a hole 5A in which a pitman, not shown, is rigidly inserted for coupling the lever 5 to the sewing machine foot pedal, not shown. The spring 6 depends from a projection 3A of the control box 3 to pull the levers upward and the spring 7 is provided in a cylindrical housing 7B with a rod 7A therein, the rod 7A being disposed between the spring 7 and the lever 5 to urge the latter downward. The spring 7 is designed to be sufficiently stronger than the spring 6 so that the lever 5 is normally located in a neutral position as illustrated by solid lines. Upon forward depression of the foot pedal by the operator, the lever 5 turns counterclockwise about its pivot point 5B against the spring 6 to a position as illustrated by dotted lines, this forward depression being limited by the engagement of the connecting shaft 12 with the lower end of the arcuate slot 4 provided on a side wall of the control box. Upon backward depression of the foot pedal, the lever 5 turns clockwise against the spring 7 until the connecting shaft 12 engages the upward end of the arcuate slot 4.

In FIG. 6, the bearing 8, mounted to an inner wall of the control box 3, is formed of molded oil-impregnated oleopolyacetal to which the pivot shaft 11 is rotatably supported, the axial movement of the shaft 11 being prevented by means of a washer 11*a* and an E-shaped retaining ring 11*b*. The permanent magnet 14 is shown insert-molded with the rotary arm 13.

FIG. 7 is an illustration of the detail of the mounting of the bearing 8 that extends through an opening in the side wall of the control box 3 and is secured thereto by screws 8*a*, 8*a*.

The foregoing description only shows preferred embodiments of the invention. Various modifications and alterations would be obvious to those skilled in the art without departing from the scope of the invention which is only limited to the appended claims.

What is claimed is:

1. A device for use in a sewing machine for generating a speed setting signal in resonse to an angular displacement caused by an operator's action, comprising:

a first member pivotally mounted at one end thereof on a first rotary axis of a stationary member and adapted to turn about said rotary axis in response to said angular displacement;

a second member pivotally mounted at one end thereof on a secondary rotary axis of said stationary member spaced from said first rotary axis;

a shaft extending transversely from one of said first and second members to the other member through an opening provided on said other member for rotatably coupling said first and second members at a point adjacent said first rotary axis but remote from said first rotary axis so that said second member rotates through an angle greater than the angle through which the first member rotates;

means for urging said first and second members against each other for minimizing the amount of loose play which might otherwise exist between said shaft and said opening;

magnetic flux generating means;

magnetic flux sensing means for generating said speed setting signal, one of the flux generating and sensing means being mounted on said second member in coaxial relationship with said secondary rotary axis, the other of said flux generating and sensing means being mounted on said stationary member coaxially with and spaced from said means mounted on said second member; and means for maintaining the spacing between the flux generating means and the flux sensing means constant in the axial direction of said second rotary means comprising:

(i) spacer means located between said flux generating means and said flux sensing means so that the flux generating means abut against oppositely disposed segments of the spacer means, and (ii) means for urging said flux generating means and said flux sensing means in a direction toward each other.

2. A device as claimed in claim 1, further comprising means for biasing said first member in opposite directions to maintain same in a neutral position.

3. A device as claimed in claim 1, wherein said stationary member is formed with an opening through which said shaft extends.

4. A device as claimed in claim 2, wherein the first and second rotary axes and a coupling point between said first and second members lie substantially along a line parallel with the longitudinal direction of said first member when the same is in said neutral position.

5. A device as claimed in claim 1, further comprising first and second oil-impregnated bearings located at said first and second rotary axes for pivotally supporting said first and second members respectively.

6. A device as claimed in claim 1, wherein said flux sensing means comprises a magnetoresistive element.

7. A device for use in a sewing maching for generating a speed setting signal in response to an angular displacement caused by an operator's action, comprising:

a first member pivotally mounted at one end thereof on a first rotary axis of a stationary member and adapted to turn about said rotary axis in response to said angular displacement;

a second member pivotally mounted at one end thereof on a second rotary axis of said stationary member spaced from said first rotary axis;

a shaft extending transversely from one of said first and second members to the other member through an opening provided on said other member for rotatably coupling said first and second members at a point adjacent said second rotary axis but remote from said first rotary axis so that said second member rotates through an angle greater than the angle which the first member rotates;

means for urging said first and second members against each other for minimizing the amount of loose play which might otherwise exist between said shaft and said opening;

means for generating a flux field;

means for sensing the flux field derived by the flux field generating means; the flux field generated and sensed by said generating and sensing means being of a type that changes in characteristic as a function of distance and offset between the flux field sensing and generating means, the flux field sensing means responding to the flux coupled to it from the flux field generating means for generating said speed setting signal, one of the flux generating and sensing means being mounted on said second member in coaxial relationship with said secondary rotary axis, the other of said flux generating and sensing means being mounted on said stationary member coaxially with and spaced from said means mounted on said second member; and means for maintaining the spacing between the flux generating means and the flux sensing means constant in the axial direction of said second rotary means comprising:

(i) spacer means located between said flux generating means and said flux sensing means so that the flux generating means abuts against oppositely disposed segments of the spacer means, and (ii) means for urging said flux generating means and said flux sensing means in a direction toward each other.

* * * * *